US008844087B2

(12) United States Patent
Marsden et al.

(10) Patent No.: US 8,844,087 B2
(45) Date of Patent: Sep. 30, 2014

(54) WIRE BRUSH

(75) Inventors: Andrew K. Marsden, Avon, OH (US); Michael C. Lambertson, Jr., Aurora, OH (US); Dennis P. De Renzo, Jr., Concord Township, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 120 days.

(21) Appl. No.: 13/168,001

(22) Filed: Jun. 24, 2011

(65) Prior Publication Data

US 2012/0096659 A1 Apr. 26, 2012

Related U.S. Application Data

(60) Provisional application No. 61/358,773, filed on Jun. 25, 2010.

(51) Int. Cl.

| | |
|---|---|
| ***A47L 13/06*** | (2006.01) |
| ***A46B 5/02*** | (2006.01) |
| ***A46B 17/08*** | (2006.01) |
| ***A46B 15/00*** | (2006.01) |
| *A46B 5/00* | (2006.01) |

(52) U.S. Cl.

CPC ..... *A46B 17/08* (2013.01); *A46B 2200/3093* (2013.01); *A46B 5/026* (2013.01); *A46B 5/02* (2013.01); *A46B 15/0081* (2013.01); *A46B 15/0055* (2013.01); *A46B 5/0095* (2013.01)

USPC ..... 15/111; 15/236.01; 15/105

(58) Field of Classification Search

CPC ..... A47L 13/34; A47L 13/06; A47L 13/12; A47L 13/022; A47L 17/06; A46B 2200/3093; A46B 5/026; A46B 15/0081

USPC ..... 15/111, 236.01

See application file for complete search history.

(56) References Cited

U.S. PATENT DOCUMENTS

| | | | | |
|---|---|---|---|---|
| 4,091,579 | A | 5/1978 | Giangiulio | |
| 4,365,380 | A | 12/1982 | Fassler | |
| 5,643,403 | A * | 7/1997 | Poole et al. | 156/762 |
| 6,966,094 | B1 | 11/2005 | Rigakos | |
| 7,818,843 | B2 * | 10/2010 | Kinskey et al. | 7/105 |
| 8,225,451 | B2 * | 7/2012 | Weinberger et al. | 15/111 |
| 2002/0040686 | A1 | 4/2002 | Willinger et al. | |

* cited by examiner

*Primary Examiner* — Shay Karls

(74) *Attorney, Agent, or Firm* — Deron A. Cook; Robert E. McDonald; Daniel A. Sherwin

(57) ABSTRACT

A wire brush may have wire type tufts extending from a head and may have a handle with only one finger separator. And/or a wire brush may have a manually detachable scraper that has a pair of tabs received in a pair of grooves formed on the brush body.

18 Claims, 9 Drawing Sheets

WIRE BRUSH

This application claims priority to U.S. Ser. No. 61/358,773, entitled LONG HANDLE WIRE BRUSH, filed Jun. 25, 2010, which is incorporated herein by reference.

I. BACKGROUND

A. Field of Invention

The present invention relates generally to wire brushes, and more specifically to wire brushes providing an improved handle.

B. Description of the Related Art

Numerous types and styles of wire brushes are known. While many known wire brushes generally work well for their intended purposes, what is needed is a wire brush that provides better performance than known wire brushes.

II. SUMMARY

According to one embodiment of this invention, a wire brush may comprise: a brush body having a proximal end and a distal end, the brush body comprising: a head on the distal end of the brush body; a handle on the proximal end of the brush body; and, only one finger separator: that is suitable to separate two fingers from an associated typical person's hand; and, that extends at least 0.25 inches downwardly from a bottom surface of the handle. A plurality of wire type tufts may extend downwardly from a bottom surface of the head. The handle may comprise a first finger receiving area on the bottom surface of the proximal side of the finger separator that is suitable to receive at least four fingers from the associated typical person's hand and a second finger receiving area on the bottom surface of the distal side of the finger separator that is suitable to receive at least one finger from the associated typical person's hand. The wire brush may have a scraper comprising a scraper body and a scraper blade where the scraper blade is suitable to scrape material from an associated surface. A mechanical fastener may be manually adjustable between: (1) an attached condition where the mechanical fastener attaches the scraper body to the brush body; and, (2) a detached condition where the mechanical fastener does not attach the scraper body to the brush body. One of the brush body and the scraper body has first and second tabs and the other of brush body and the scraper body has first and second grooves that receive the first and second tabs when the mechanical fastener is in the attached condition.

According to another embodiment of this invention, a wire brush may comprise: a brush body having a proximal end and a distal end, the brush body comprising: a head on the distal end of the brush body; a handle on the proximal end of the brush body; and, only one finger separator: that is suitable to separate two fingers from an associated typical person's hand; and, that extends at least 0.25 inches downwardly from a bottom surface of the handle. A plurality of wire type tufts may extend downwardly from a bottom surface of the head. The handle may comprise a first finger receiving area on the bottom surface of the proximal side of the finger separator that is suitable to receive at least four fingers from the associated typical person's hand; and, a second finger receiving area on the bottom surface of the distal side of the finger separator that is suitable to receive at least one finger from the associated typical person's hand.

According to yet another embodiment of this invention, a wire brush may comprise: a brush body comprising a head from which a plurality of wire type tufts extend; a scraper comprising a scraper body and a scraper blade; wherein the scraper blade is suitable to scrape material from an associated surface; and, a mechanical fastener that is manually adjustable between: (1) an attached condition where the mechanical fastener attaches the scraper body to the brush body; and, (2) a detached condition where the mechanical fastener does not attach the scraper body to the brush body. One of the brush body and the scraper body has first and second tabs and the other of brush body and the scraper body has first and second grooves that receive the first and second tabs when the mechanical fastener is in the attached condition.

Numerous benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

Figure 1:
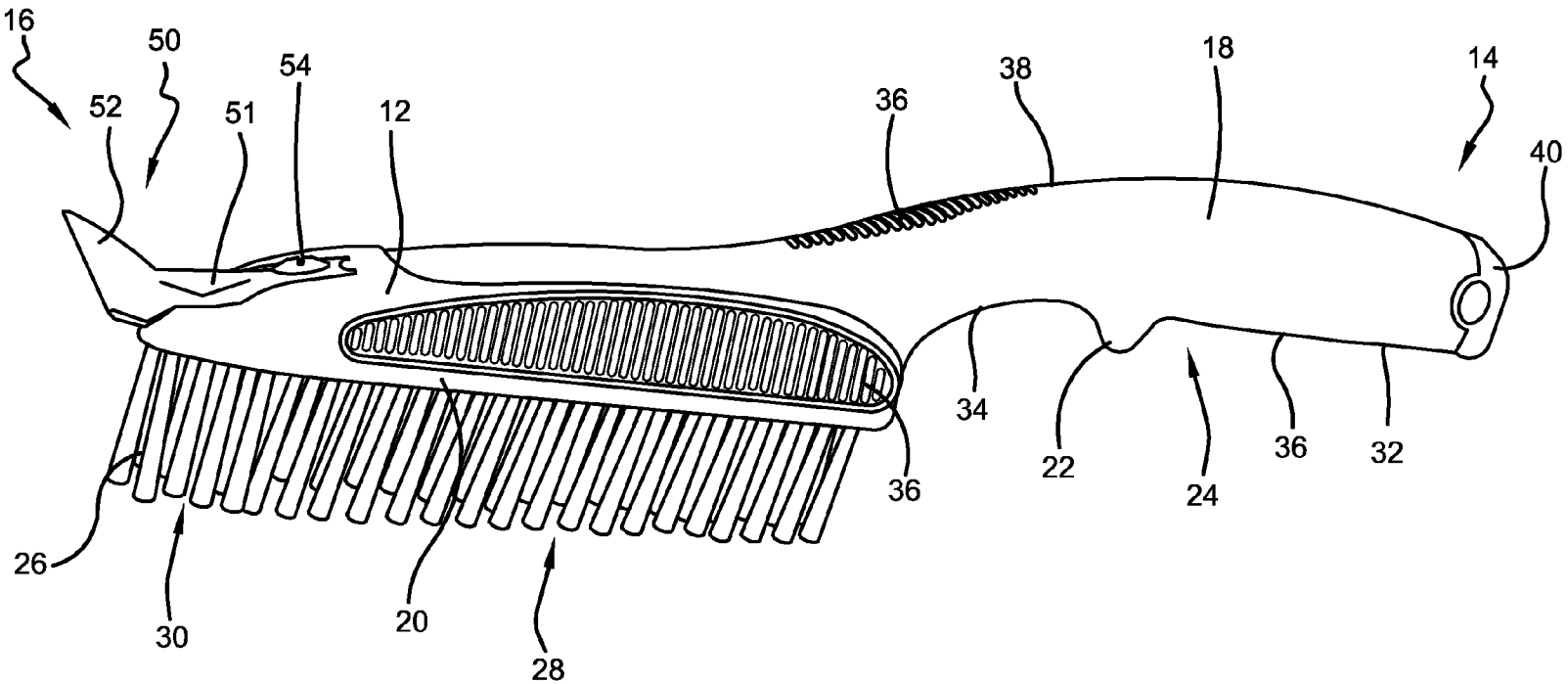
FIG. 1 is a perspective view of a wire brush according to one embodiment of this invention.
Figure 2:
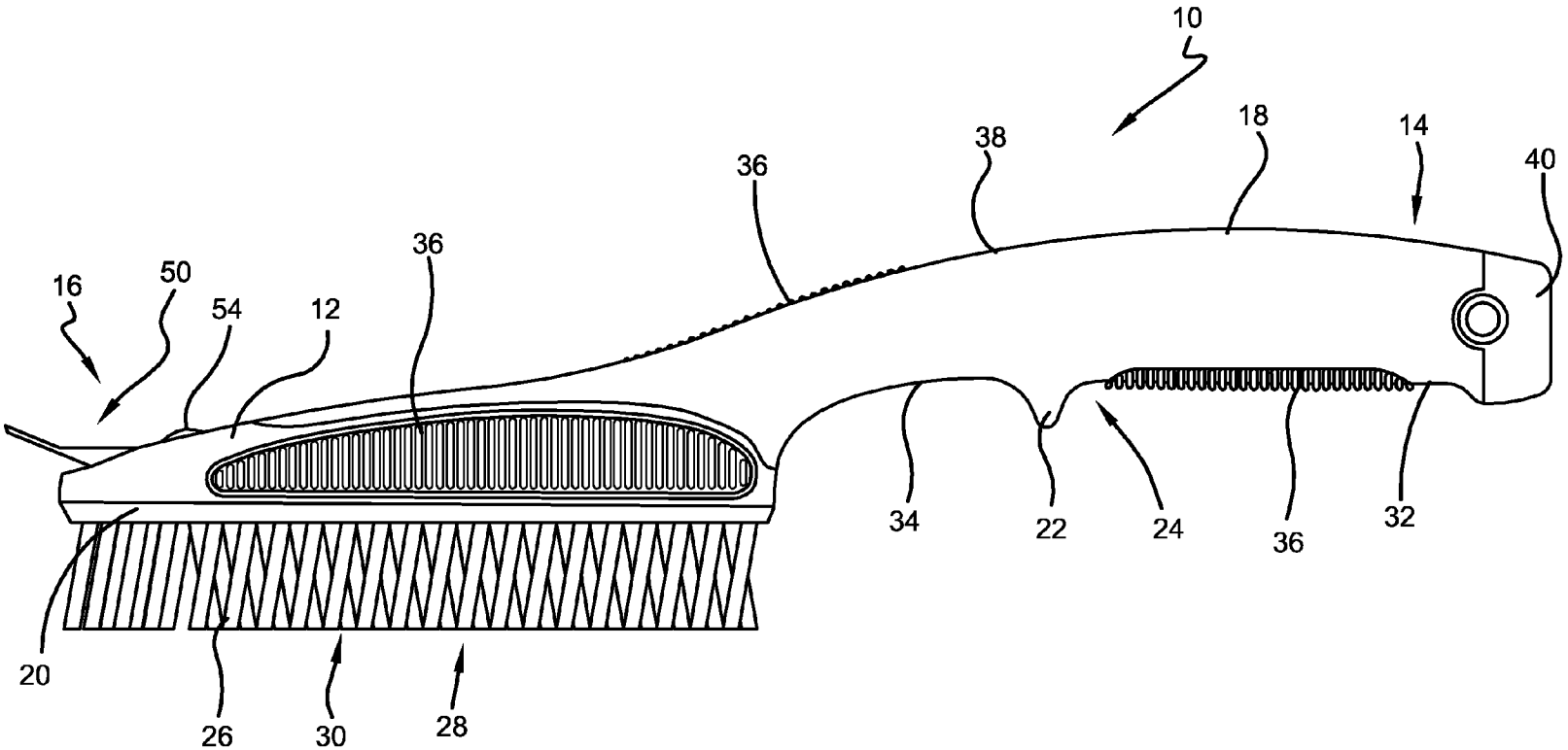
FIG. 2 is a side view of the wire brush shown in FIG. 1.
Figure 3:
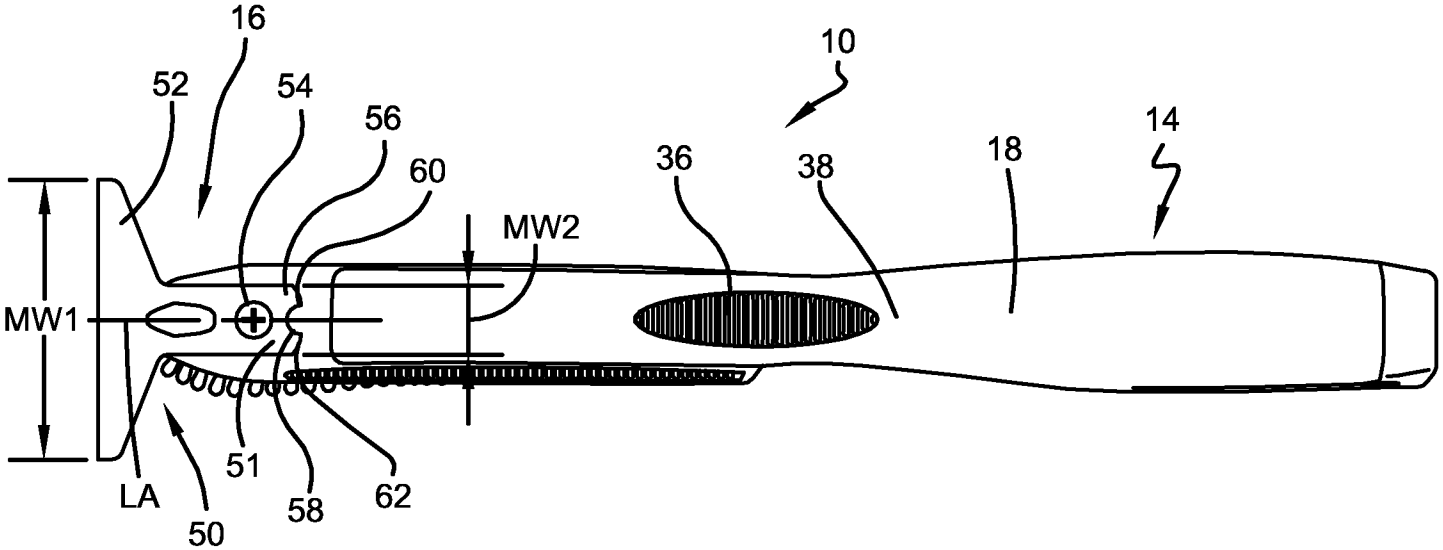
FIG. 3 is a top view of the wire brush shown in FIG. 1.
Figure 4:
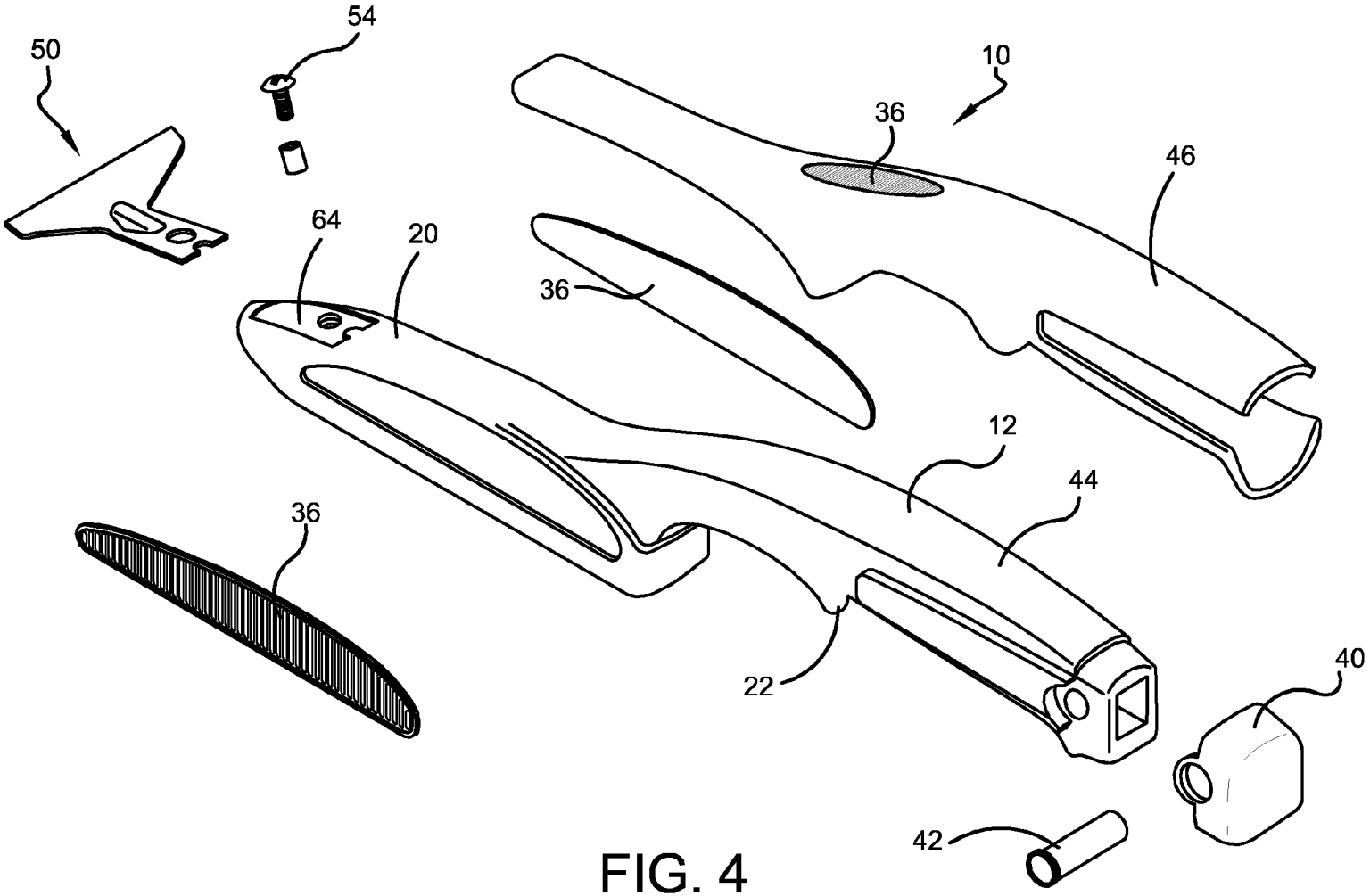
FIG. 4 is an assembly view of the wire brush shown in FIG. 1.
Figure 5:
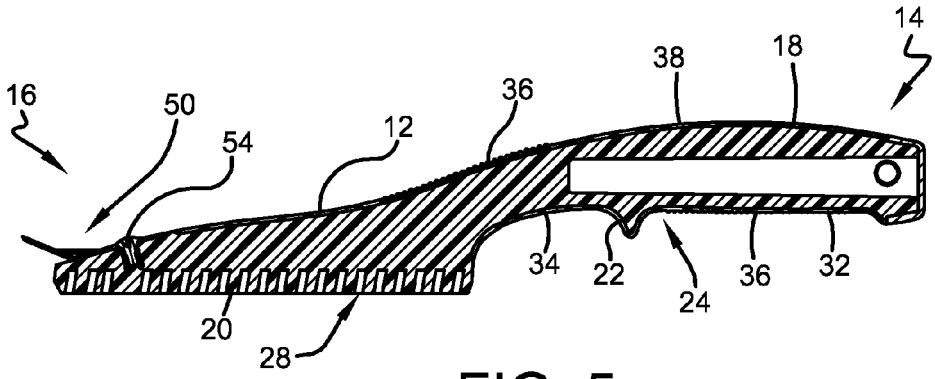
FIG. 5 is a sectional view through line 5-5 in FIG. 6.
Figure 6:
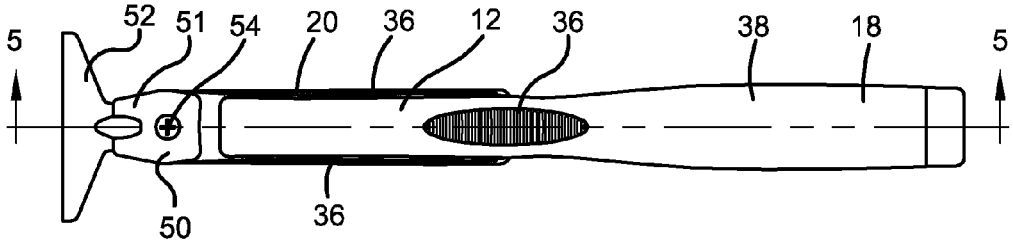
FIG. 6 is a top view of a wire brush according to another embodiment of this invention.
Figure 7:
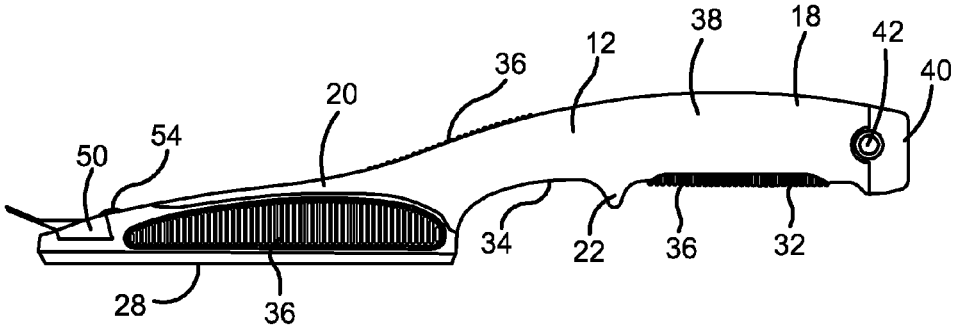
FIG. 7 is a side view of the wire brush shown in FIG. 6.
Figure 8:
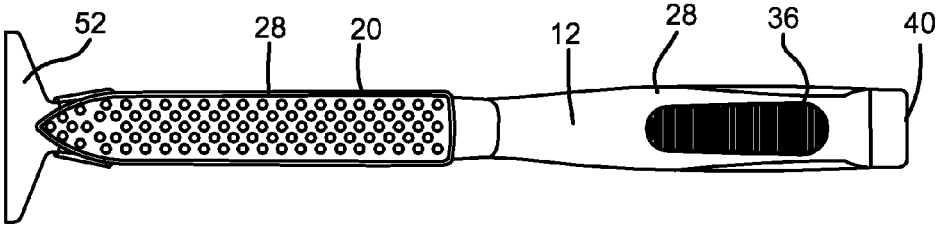
FIG. 8 is a bottom view of the wire brush shown in FIG. 6.
Figure 10:
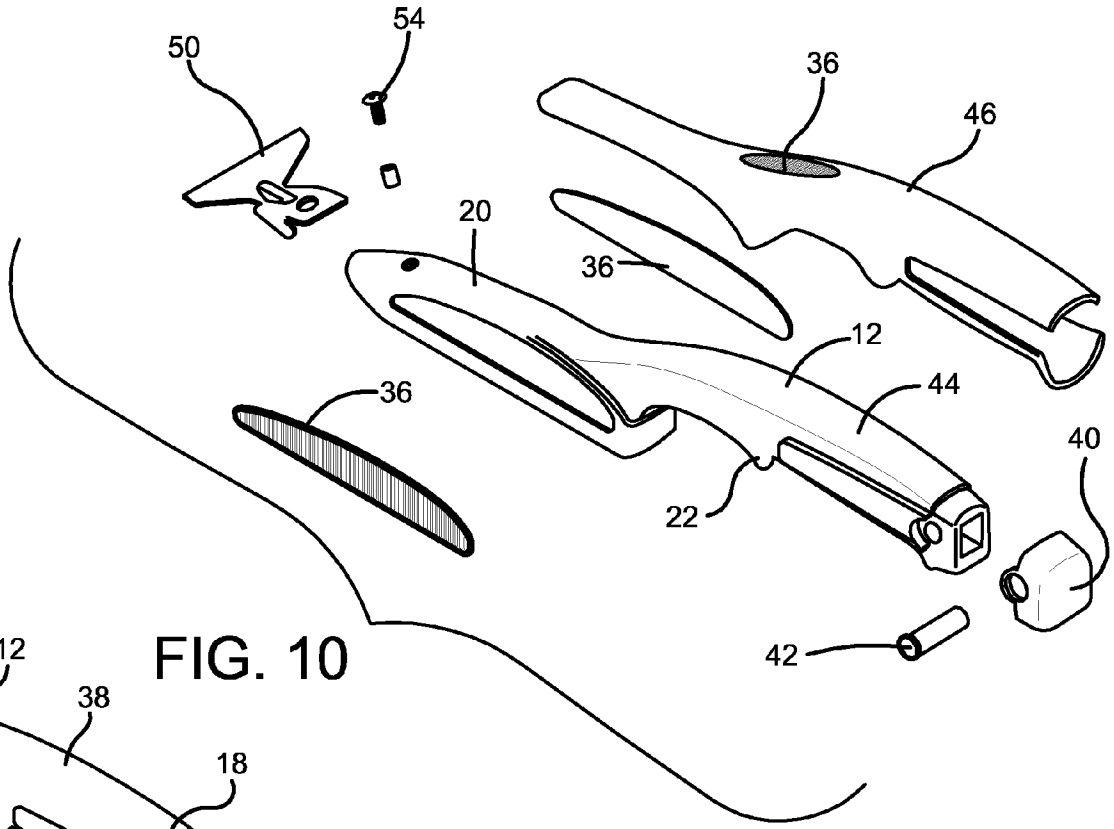
FIG. 10 is an assembly view of the wire brush shown in FIG. 6.
Figure 9:
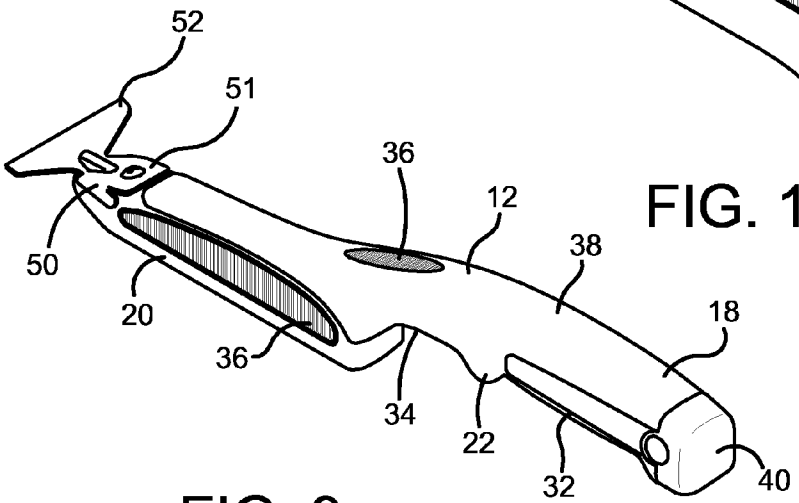
FIG. 9 is a perspective view of the wire brush shown in FIG. 6.
Figure 11:
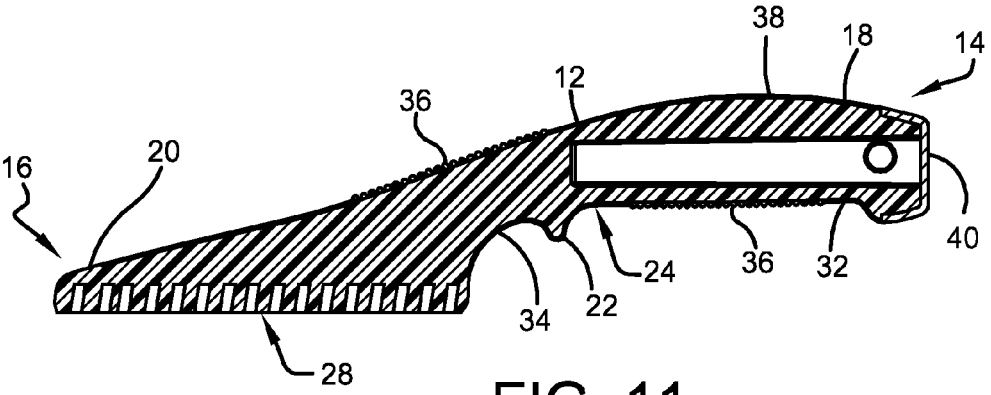
FIG. 11 is a section view through line 11-11 in FIG. 12.
Figure 12:
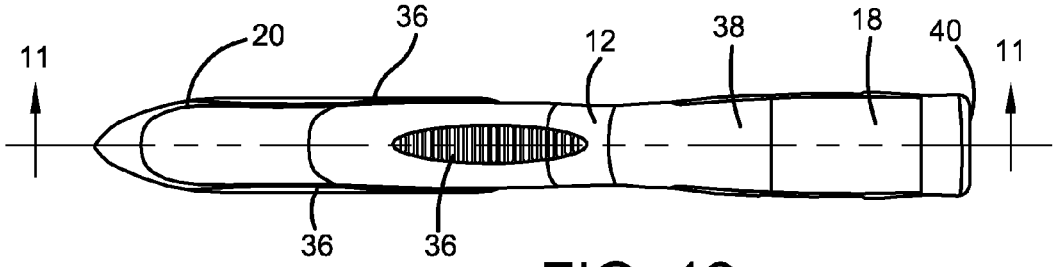
FIG. 12 is a top view of wire brush according to yet another embodiment of this invention.
Figure 13:
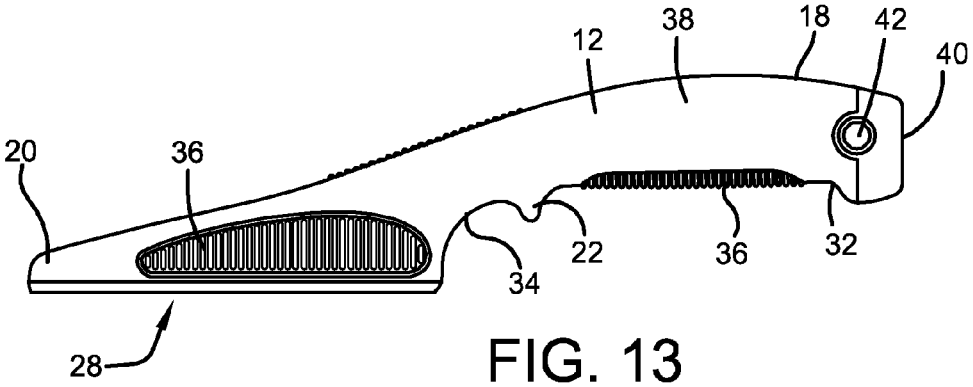
FIG. 13 is a side view of the wire brush shown in FIG. 12.
Figure 14:
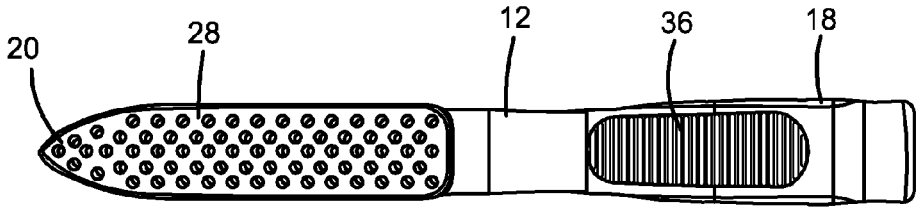
FIG. 14 is a bottom view of the wire brush shown in FIG. 12.
Figure 16:
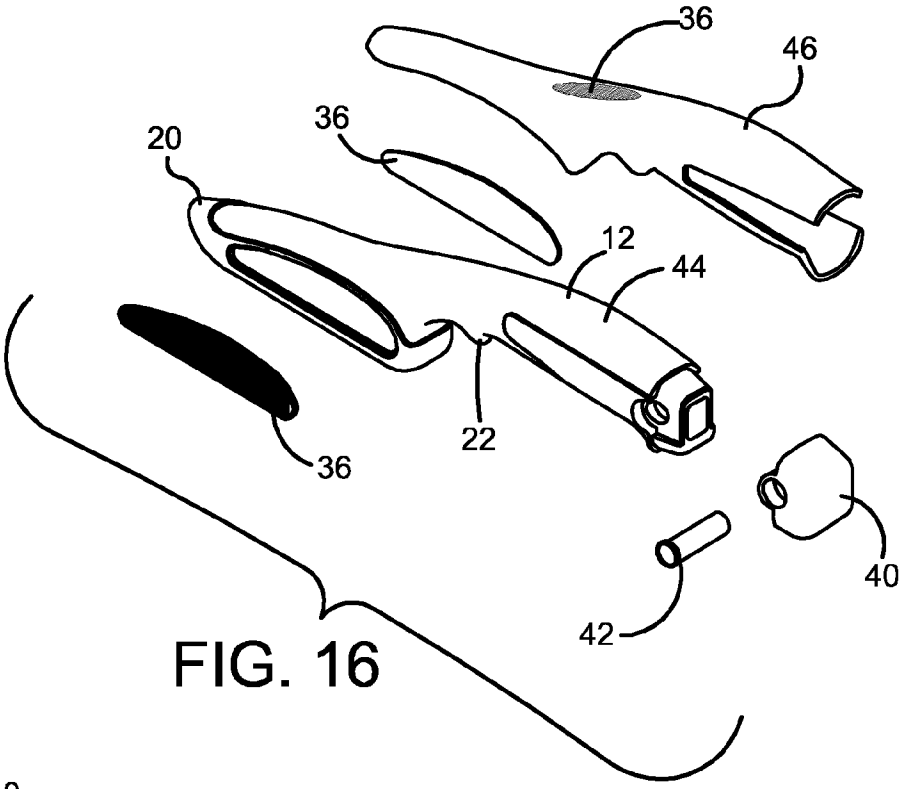
FIG. 16 is an assembly view of the wire brush shown in FIG. 12.
Figure 15:
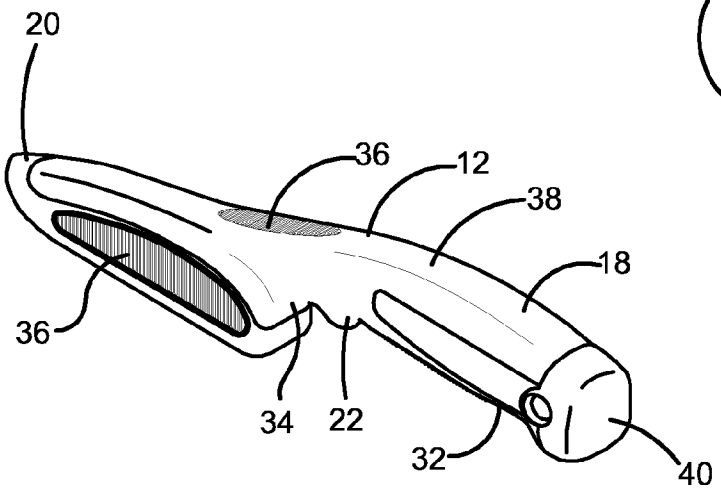
FIG. 15 is a perspective view of the wire brush shown in FIG. 12.

Referring now to the drawings wherein the showings are for purposes of illustrating embodiments of the invention only and not for purposes of limiting the same, and wherein like reference numerals are understood to refer to like components, FIGS. 1-4 show a wire brush 10 having a brush body 12. For reference purposes only, the term "proximal" will be used to refer to one end of the brush 10 and the term "distal" will be used to refer to the opposite end. For the embodiments shown in FIGS. 1-16, the proximal end 14 is the end having a handle 18 and the distal end 16 is the end having a head 20, but this reference structure is not a requirement for this invention.

A plurality of wire type tufts 26 may extend downwardly from a bottom surface 28 of the head 20. A tuft 26 can include one or more filaments or bristles 30. The specific number of filaments or bristles used to make up one tuft 26 can be any number chosen by a person of ordinary skill in the art. By "wire type" tufts it is meant that the materials used to make the bristles 30 forming the tufts 26 are relatively stiff and thus useful for non-limiting purposes such as removing paint from a surface. The material used to make the bristles 30 may, in one embodiment, include a metal. In one specific embodiment, all the tufts 26 are formed exclusively of steel bristles 30, which may be stainless steel, high carbon steel, galvanized steel or the like. In other embodiments, tufts 26 may be formed of aluminum, brass, bronze, or other alloys. In still other embodiments, tufts 26 may be formed of synthetic or natural fibers, including nylon, abrasive nylon, conductive nylon, polyester, polypropylene, polyethylene, horsehair and tampico fiber. As the use of a wire brush is well known to persons of skill in the art, details will not be provided here.

A finger separator 22 may extend downwardly from a bottom surface 24 of the handle 18, as shown. By "finger separator" it is meant a component that is suitable and indented to physically separate two neighboring fingers on a person's hand. The finger separator 22 can be of any size and shape chosen with the sound judgment of a person of skill in the art. In one embodiment, the finger separator 22 may extend at least 0.25 inches from the bottom surface 24 of the handle 18. In another embodiment, the finger separator 22 may extend at least 0.375 inches from the bottom surface 24 of the handle 18. In one embodiment, shown, only one finger separator 22 is used with the wire brush 10. This improves the options for using the handle 18 as will be discussed further below. The handle 18 may have first and second finger receiving areas 32, 34 on the bottom surface 24 of the handle 18. The first finger receiving area 32 is on the proximal side of the finger separator 22 and is suitable to receive at least four fingers from a typical person's hand. In one non-limiting embodiment, the first finger receiving area 32 is approximately 3.5 inches long. The second finger receiving area 34 is on the distal side of the finger separator 22 and is suitable in one embodiment to receive one finger from a typical person's hand. In another embodiment, the second finger receiving area 34 is suitable to receive two fingers from a typical person's hand. In yet another embodiment, the second finger receiving area 34 is suitable to receive three fingers from a typical person's hand.

With continuing reference to FIGS. 1-4, the wire brush 10 may have one or more frictional grip surfaces 36 to facilitate gripping the wire brush 10 when the wire brush 10 is applied to a surface. The number, style, size, and location of frictional grip surfaces positioned on the wire brush 10 can be any chosen with the sound judgment of a person of skill in the art. For the embodiment shown, the frictional grip surfaces 36 are formed of multiple ribs that extend from the surface of the wire brush 10. In one embodiment, there may be a frictional grip surface 36 located on either side or both sides of the head 20. In one embodiment, either or both of the frictional grip surfaces 36 on the head 20 are suitable to receive four fingers from a typical person's hand. In one non-limiting embodiment, each frictional grip surfaces 36 located on the side of the head 20 is approximately 4.5 inches long. In another embodiment, there may be a frictional grip surface 36 located on the first finger receiving area 32. In one specific embodiment, the frictional grip surface 36 located on the first finger receiving area 32 is suitable to receive four fingers from a typical person's hand. In yet another embodiment, there may be a frictional grip surface 36 located on a top surface 38 of the brush body 12. For the embodiment shown, the frictional grip surface 36 located on the top surface 38 extends from above the proximal end of the head 20 to above the distal end of the handle 18.

In one embodiment a hammer surface 40 may be positioned on the wire brush 10 and used to forcefully strike a surface as is well known to those of skill in the art. For the embodiment shown, the hammer surface 40 is positioned on the proximal end of the handle 14. The hammer surface 40 can be formed of any material and may be of any style and size chosen with the sound judgment of a person of skill in the art. For the embodiment shown, the hammer surface 40 is a metal cap held to the proximal end of the handle 18 with a swage collar 42.

The brush body 12 may be formed of any material and in any manner chosen with the sound judgment of a person of skill in the art. In one embodiment, the brush body 12 includes an inner structure 44 formed of polypropylene and an overmold 46 formed of a santoprene rubber.

With reference now to FIGS. 1-16, it should be noted that the wire brush 10 described is well suited to provide at least four different use options. A first use option is a one hand option where the user grips the proximal end of the handle 18 with one hand and places all four fingers of the hand (it being understood that the user's thumb would be placed on the side or top of the handle 20) in the first finger receiving area 32. The finger separator 22 may be used to limit the relative motion of the hand with respect to the wire brush 10 in the distal direction (the person's index finger may abut the proximal side of the finger separator 22). A second use option is a one hand option where the user grips the handle 18 with one hand and places at least one finger (at least the index finger) in the second finger receiving area 34 while the remaining fingers of the hand (it being understood that the user's thumb would be placed on the side or top of the handle 20) are placed in the first finger receiving area 32. With this use option, the distal side of the finger separator 22 may be used as a "trigger" grip surface for the finger in the second finger receiving area 34 nearest the finger separator 22. A third use option is a one hand option where the user grips the head 20 with one hand by placing the thumb on one side of the head 20 while the remaining fingers are placed on the other side of the head 20. A fourth use option is a two hand option which combines either the first or second use option with one hand and the third use option with the other hand. The use of frictional grip surfaces 36 would improve the grip friction for the user when using the wire brush 10.

With reference now to FIGS. 1-10, the wire brush 10 may include a scraper 50 having a scraper body 51 and a scraper blade 52 that is suitable to scrape material from a surface as is well known to those of skill in the art. In one embodiment, the scraper 50 is permanently fixed to the brush body 12. In another embodiment, the scraper 50 is removable. In one specific embodiment, a mechanical fastener 54 is manually adjustable between: (1) an attached condition where the mechanical fastener attaches the scraper body 51 to the brush body 12; and, (2) a detached condition where the mechanical fastener 54 does not attach the scraper body 51 to the brush body 12. The mechanical fastener 54 can be of any type and size chosen with the sound judgment of a person of skill in the art, such as a screw. In one embodiment either the brush body 12 or the scraper body 51 has first and second tabs 56, 58 and the other (either the scraper body 51 or the brush body 12) has first and second grooves 60, 62 that receive the first and second tabs 56, 58 when the mechanical fastener 54 is in the attached condition.

With reference now to FIGS. 1-4, in one embodiment the scraper body 51 is inlayed into a cutout 64 formed in the brush body 12 when the mechanical fastener 54 is in the attached condition. The cutout 64, in one embodiment, comprises the first and second grooves 60, 62 and the scraper body 51 comprises the first and second tabs 56, 58. For the embodiment shown, the cutout 64 is formed only in the top surface 38 of the brush body 12 and the only portion of the scraper 50 that extends outside of the cutout 64 when the mechanical fastener 50 is in the attached condition is the scraper blade 52. The scraper 50 may be positioned with its longitudinal axis LA bisecting the first and second tabs 56, 58 and bisecting the mechanical fastener 54 when the mechanical fastener 58 is in the attached condition. A ratio of the maximum width MW1 of the scraper blade 52 to the maximum width MW2 of the scraper body 51 may be at least 4.0. These embodiments improve the structural integrity of the removable scraper 50. As shown, the scraper blade 52 may extend from the distal end of the head 20. The scraper 50 may be formed of any material chosen with the sound judgment of a person of skill in the art. In one embodiment the scraper blade 52 has a carbide tip 66.

Figure 18:
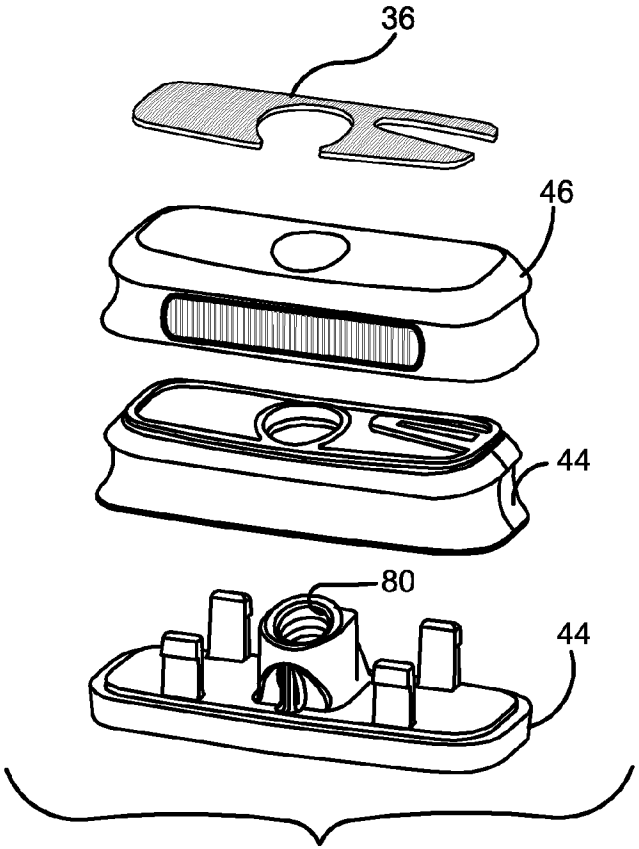
FIG. 18 is an assembly view of the wire brush shown in FIG. 17.
Figure 17:
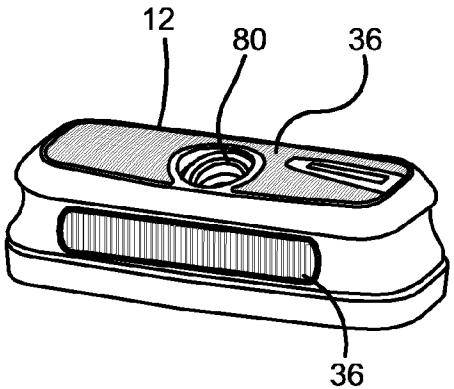
FIG. 17 is a perspective view of still another embodiment of this invention.

FIGS. 5-10 show another embodiment wire brush that is similar to that shown in FIGS. 1-4 but with a different scraper 50. FIGS. 11-16 show another embodiment wire brush that is smaller than the wire brush shown in FIGS. 1-4 and that does not have a scraper. FIGS. 17-18 show another embodiment wire brush that has a handle reception opening 80 for receiving a handle (not shown) and that does not have a scraper.

Numerous embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

We claim:

1. A wire brush comprising:

a brush body having a proximal end and a distal end, the brush body comprising: a head having first and second sides on the distal end of the brush body; a handle on the proximal end of the brush body; and, only one finger separator: that is suitable to separate two fingers from an associated typical person's hand; and, that extends at least 0.25 inches downwardly from a bottom surface of the handle;

a frictional grip surface on the first side of the head;

a frictional grip surface on the second side of the head;

a frictional grip surface on a top surface of the brush body;

a plurality of wire type tufts extending downwardly from a bottom surface of the head;

a scraper comprising a scraper body and a scraper blade; wherein the scraper blade is suitable to scrape material from an associated surface;

wherein the handle comprises a first finger receiving area on the bottom surface of the proximal side of the finger separator that is suitable to receive at least four fingers from the associated typical person's hand and a frictional grip surface on the first finger receiving area;

wherein the handle comprises a second finger receiving area on the bottom surface of the distal side of the finger separator that is suitable to receive at least one finger from the associated typical person's hand; and, wherein the frictional grip surfaces on the first and second sides of the head do not extend onto the bottom surface of the head and are each suitable to receive four fingers from the associated typical person's hand.

2. The wire brush of claim 1 wherein:

the wire type tufts are formed exclusively of aluminum bristles; and, the brush body is formed of an inner polypropylene structure with a santoprene rubber overmold.

3. The wire brush of claim 1 wherein the proximal end of the handle comprises a metal hammer surface.

4. The wire brush of claim 1 wherein:

the scraper body is inlayed into a cutout formed in the brush body when the mechanical fastener is in the attached condition;

the cutout comprises the first and second grooves; and, the scraper body comprises the first and second tabs.

5. The wire brush of claim 1 further comprising:

a mechanical fastener that is manually adjustable between: (1) an attached condition where the mechanical fastener attaches the scraper body to the brush body; and, (2) a detached condition where the mechanical fastener does not attach the scraper body to the brush body; and, wherein one of the brush body and the scraper body has first and second tabs and the other of brush body and the scraper body has first and second grooves that receive the first and second tabs when the mechanical fastener is in the attached condition.

6. A wire brush comprising:

a brush body having a proximal end and a distal end, the brush body comprising: a head on the distal end of the brush body; a handle on the proximal end of the brush body; and, only one finger separator: that is suitable to separate two fingers from an associated typical person's hand; and, that extends at least 0.25 inches downwardly from a bottom surface of the handle;

wherein a plurality of wire type tufts extend downwardly from a bottom surface of the head;

wherein the handle comprises a first finger receiving area on the bottom surface of the proximal side of the finger separator that is suitable to receive at least four fingers from the associated typical person's hand;

wherein the handle comprises a second finger receiving area on the bottom surface of the distal side of the finger separator that is suitable to receive at least two fingers from the associated typical person's hand; and wherein the head has first and second sides, a bottom surface, and a frictional grip surface wholly encompassed on the first side of the head.

7. The wire brush of claim 6 wherein the second finger receiving area is suitable to receive at least three fingers from the associated typical person's hand.

8. The wire brush of claim 6 wherein:

there is a frictional grip surface wholly encompassed on the second side of the head; and, the frictional grip surfaces on the first and second sides of the head are each suitable to receive four fingers from the associated typical person's hand.

9. The wire brush of claim 6 wherein there is a frictional grip surface on a top surface of the brush body.

10. The wire brush of claim 6 wherein there is a frictional grip surface on the first finger receiving area.

11. The wire brush of claim 6 wherein the proximal end of the handle comprises a metal hammer surface.

12. The wire brush of claim 6 wherein the wire type tufts are formed exclusively of aluminum bristles.

13. The wire brush of claim 6 wherein the brush body is formed of an inner polypropylene structure with a santoprene rubber overmold.

14. The wire brush of claim 6 further comprising:

a scraper comprising a scraper body and a scraper blade; wherein the scraper blade is suitable to scrape material from an associated surface;

a mechanical fastener that is manually adjustable between: (1) an attached condition where the mechanical fastener attaches the scraper body to the brush body; and, (2) a detached condition where the mechanical fastener does not attach the scraper body to the brush body; and, wherein one of the brush body and the scraper body has first and second tabs and the other of brush body and the scraper body has first and second grooves that receive the first and second tabs when the mechanical fastener is in the attached condition.

15. The wire brush of claim 14 wherein:

the scraper body is inlayed into a cutout formed in the brush body when the mechanical fastener is in the attached condition;

the cutout comprises the first and second grooves; and, the scraper body comprises the first and second tabs.

16. The wire brush of claim 15 wherein:

the brush body comprises a top surface;

the cutout is formed only in the top surface of the brush body; and, the only portion of the scraper that extends outside of the cutout when the mechanical fastener is in the attached condition is the scraper blade.

17. The wire brush of claim 16 wherein:

the scraper has a longitudinal axis that bisects the first and second tabs and that bisects the mechanical fastener when the when the mechanical fastener is in the attached condition;

the mechanical fastener is positioned between the first and second tabs and the scraper blade when the mechanical fastener is in the attached condition;

a ratio of the maximum width of the scraper blade to the maximum width of the scraper body is at least 4.0.

18. The wire brush of claim 17 wherein:

the brush body comprises a handle that extends from the proximal end of the head; and, the scraper blade extends from the distal end of the head.

* * * * *